United States Patent [19]

Foss et al.

[11] Patent Number: 4,658,786

[45] Date of Patent: Apr. 21, 1987

[54] LOSS OF INPUT SIGNAL DETECTION AND RESPONSE SYSTEM FOR USE WITH DISTRIBUTORLESS IGNITION SYSTEMS

[75] Inventors: Leonard Foss, Lombard; David Cousins, Carol Stream; Edward Li, Roselle, all of Ill.

[73] Assignee: Motorola, Inc., Schaumburg, Ill.

[21] Appl. No.: 843,969

[22] Filed: Mar. 25, 1986

[51] Int. Cl.[4] ..... F02P 7/077; F02P 11/00

[52] U.S. Cl. ..... 123/414; 123/630; 123/643

[58] Field of Search ..... 123/414, 416, 417, 479, 123/630, 643

[56] References Cited

U.S. PATENT DOCUMENTS 4,450,815 5/1984 Mouri ..... 123/416 X

FOREIGN PATENT DOCUMENTS 58-48 1/1982 Japan ..... 123/417
157061 9/1982 Japan ..... 123/417
198366 12/1982 Japan ..... 123/630
222977 12/1983 Japan ..... 123/630
58-81 1/1984 Japan ..... 123/630
2160587 12/1985 United Kingdom ..... 123/417

*Primary Examiner*—Tony M. Argenbright
*Attorney, Agent, or Firm*—Steven G. Parmelee

[57] ABSTRACT

An invention for detecting loss of input signals to a distributorless ignition system (17) and for providing appropriate responses upon detecting fault conditions. If a SPOUT signal (31) faults low, the invention will control ignition sequence through use of a CID signal (14), and the CID signal (14) and a PIP signal (13) will be operably substituted for the missing SPOUT signal (31) to assure timely ignition. If the SPOUT signal (31) faults high, the CID signal (14) will again be utilized to sequence the firing sequence and the PIP signal (13) will be substituted for the SPOUT signal (31). If the CID signal (14) faults, firing sequence will continue to be incremented in response to receipt of the SPOUT signal (31). In addition, the invention provides for recovery of normal operation should any of the above fault conditions prove to be transient.

15 Claims, 5 Drawing Figures

10
SPOUT
31
PIP
13
CID
14
PU
116
TWO SHOT
TWO SHOT

LOSS OF INPUT SIGNAL DETECTION AND RESPONSE SYSTEM FOR USE WITH DISTRIBUTORLESS IGNITION SYSTEMS

TECHNICAL FIELD

This invention relates generally to detecting loss of input signal and providing an appropriate response upon detecting such a loss, particularly in the environment of a distributorless ignition system.

BACKGROUND ART

There are two main types of internal combustion engines currently in use; the compression ignition engine and the spark ignition engine. In the latter, an explosive mixture of fuel and oxygen located in a confined space ignites through exposure to an electric spark. The resulting explosion provides force that the engine converts into useful work.

To properly control this process, the timing and duration of the spark must be controlled. These needs become particularly acute in a multichambered engine where numerous explosions in various combustion chambers must be sequentially ordered to assure proper functioning of the mechanical aspects of the engine. A distributor has traditionally been used to aid in this control process. A distributor, however, makes use of moving parts that are subject to wear. Further, the quality of the spark provided through use of such a system can deteriorate over time due to physical wear and tear of the distributor and its related components.

In response to these problems, distributorless ignition systems have begun to be used to control the spark. In such a system (see FIG. 1), an engine position sensing unit (A), such as a toothed wheel sensor and related components, sense engine position and engine speed and provide a PIP (profile ignition pickup) signal that relates to crankshaft location and a CID (cylinder identification) signal that relates to identification of a particular cylinder, such as the number one cylinder. These two signals may then be provided to an electronic engine control (B) that creates a SPOUT (spark output) signal that contains spark advance/retard and dwell information. An output logic unit (C) may then control a distributorless ignition system (D) in response to the SPOUT and CID signals to produce a proper spark.

Although such distributorless ignition systems as described above avoid the problems noted with respect to distributor based ignition systems, these distributorless ignition systems have given rise to new problems. For instance, the CID signal can be temporarily lost, as can the SPOUT signal. In addition, the SPOUT signal can fault either high or low, yielding different system response problems. When such faults occur, the engine will often be rendered nonsuitable for its intended purposes.

There therefore exists a need for a system that will allow a distributorless ignition system to compensate, at least to some satisfactory degree, for transitory loss of input signals.

SUMMARY OF THE INVENTION

These needs are substantially met through provision of the loss of input signal detection and response system disclosed in this specification. This system operates in conjunction with: (1) an engine; (2) an engine position sensing unit that provides: (A) a PIP signal relating to crankshaft location information for the engine; and (B) a CID signal relating to identification of a particular cylinder in that engine; and (3) an electronic engine control unit that receives the PIP and CID signals and that provides a SPOUT signal containing spark advance/retard and dwell information to a distributorless ignition system. The distributorless ignition system responds to this information by providing spark control signals. The loss of input signal detection and response system includes a SPOUT high detection unit, a SPOUT low detection unit, and a firing sequence counter unit.

The SPOUT high detection unit detects when the SPOUT signal faults high and functions to replace the faulted SPOUT signal with the PIP signal to ensure continued proper outputting of spark control signals from the system. Though the PIP signal will not reflect the advance/retard and dwell information calculated by the electronic engine control unit, the PIP signal will allow satisfactory operation of the engine pending appropriate repairs to the system. Further, if the SPOUT signal faults high for only a transitory period, the system will respond by allowing the again functioning SPOUT signal to resume control of the spark control signal without intervention by an operator.

The SPOUT low detection unit detects when the SPOUT signal faults low and causes both the PIP signal and the CID signal to be substituted therefor in various capacities. Also, as with the SPOUT high detection unit, the SPOUT low detection unit will allow the SPOUT signal to resume control upon returning from a fault low condition. In this regard, however, the SPOUT low detection unit includes a delay mechanism for ensuring that SPOUT has truly reliably returned from a fault low condition prior to allowing this signal to resume control, and to also ensure proper positioning of the SPOUT signal with respect to the firing sequence order (since SPOUT returning at an inopportune time could cause the firing sequence to be disturbed).

The firing sequence counter unit receives signals related to both the SPOUT signal and the CID signal, and based upon these signals, determines the proper firing sequence for the engine. During ordinary operation, the SPOUT signal will increment the firing sequence counter unit to assure proper firing in the next cylinder. The CID signal, under these circumstances, serves to confirm the SPOUT commands and to correct the firing sequence counter unit if for any reason the count has lost synchronization with the engine. The firing sequence counter unit, however, will continue to properly increment when either the SPOUT signal or the CID signal faults.

When the firing sequence counter operates only in response to SPOUT, as occurs during a CID signal fault, the engine will continue to operate properly until switched off by an operator. At this time, the system includes a mechanism for preventing the firing sequence counter from again initiating, as, in the absence of the CID signal, an initial determination regarding cylinder identification cannot be made and hence the firing sequence counter cannot be properly initiated.

Through use of this invention, a variety of loss of input signal events can be tolerated without immediate or undue compromise of engine operation.

BRIEF DESCRIPTION OF THE DRAWINGS

These and other attributes of the invention will become more clear upon making a thorough review and study of the following description of the best mode for carrying out the invention, particularly when reviewed in conjunction with the drawings, wherein.

BEST MODE FOR CARRYING OUT THE INVENTION

Figure 2:
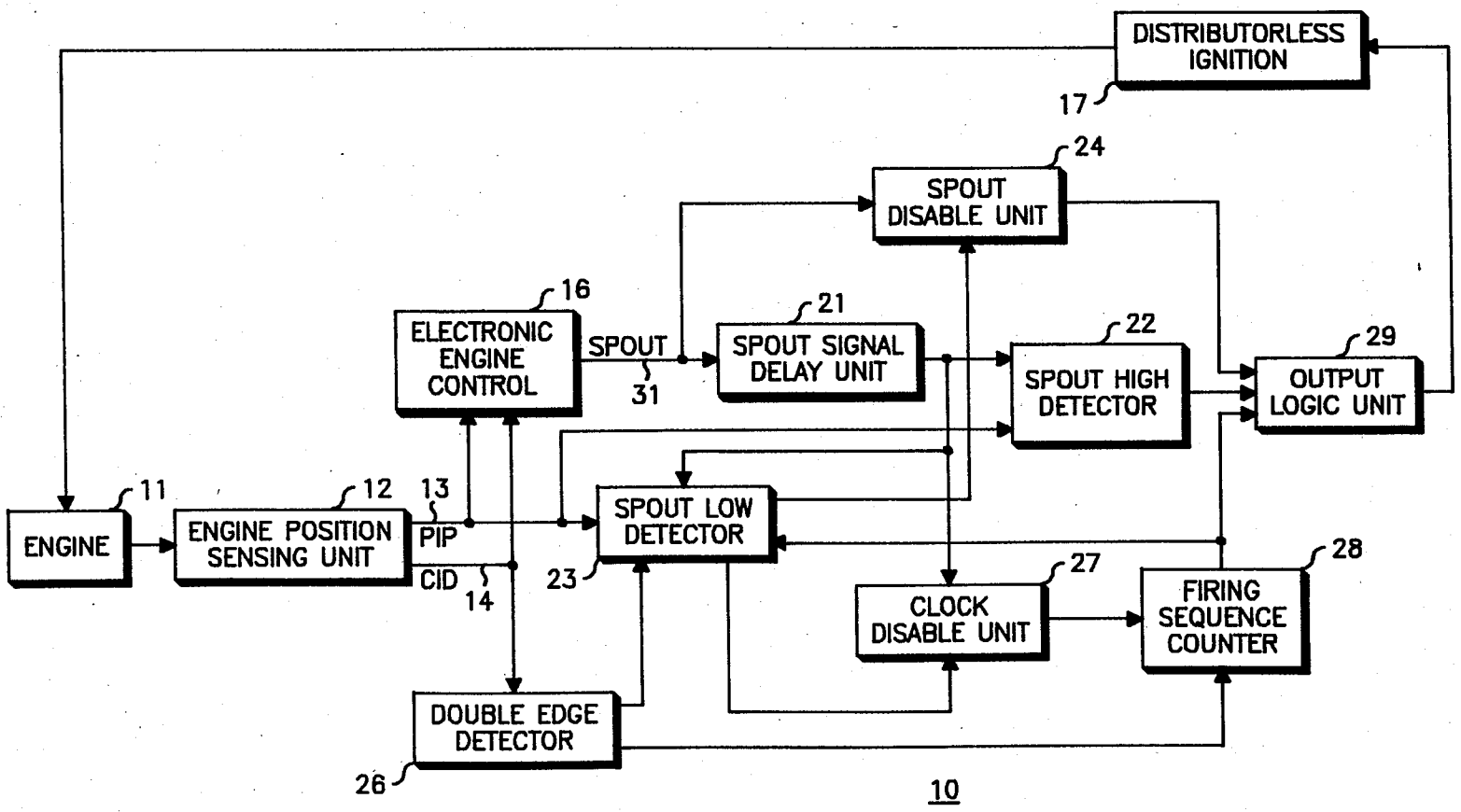
FIG. 2 comprises a block diagram depiction of the invention as used in a distributorless ignition system.

Referring now to the drawings, and in particular to FIG. 2, the invention can be seen as depicted generally by the numeral 10. The invention (10) operates in conjunction with a spark ignition internal combustion engine (11), an engine position sensing unit (12) capable of providing a PIP signal (13) and a CID signal (14), an electronic engine control (16) capable of providing a SPOUT signal (31), and a distributorless ignition spark control system (17). The invention (10) includes generally a SPOUT signal delay unit (21), a SPOUT high detector (22), a SPOUT low detector (23), a SPOUT disable unit (24), a double edge detector (26), a clock disable unit (27), a firing sequence counter (28), and an output logic unit (29). Each of the above generally referred to components will now be described in more detail in seriatim fashion.

With continued reference to FIG. 2, the engine (11) will typically be comprised of an internal combustion engine that provides combustion by exposing a gaseous fuel/oxygen mixture to a spark. The engine (11) will typically have a crankshaft (not shown) or other similar mechanical device for allowing power generated by the engine (11) to be mechanically translated into useful work. The position of this crankshaft can be sensed through use of a variety of known engine position sensing units (12). The engine position sensing unit (12), in addition to providing such other signals as may be appropriate to the given application, provides a PIP signal (13) and a CID signal (14). Both of these signals (13 and 14) are provided to an electronic engine control (16) that, in addition to such other tasks as may be assigned it, produces a SPOUT signal (31) in accordance with known prior art technique. The distributorless ignition (17), in response to control signals the character of which will be described in more detail below, controls the application of sparks within the engine (11) to thereby control the combustion process.

With respect to the invention (10) itself, under ordinary operating circumstances, the control signal to the distributorless ignition (17) constitutes the output of the output logic unit (29). In general, the output of this unit (29) will be a function of the SPOUT signal (31) and the output of the firing sequence counter (28). These two signals control the timing and duration of the applied spark, and the cylinder to which the spark becomes applied to.

The SPOUT signal delay unit (21) provides a delayed SPOUT signal. The SPOUT signal delay unit (21) connects to the SPOUT high detector (22), the SPOUT low detector (23), and the clock disable unit (27).

The SPOUT high detector (22) monitors the delayed SPOUT signal and causes the PIP signal (13) to be provided to the output logic unit (29) when the SPOUT signal (31) has faulted high, thereby allowing the PIP signal (13) to substitute for the SPOUT signal (31).

The SPOUT low detector (23) receives the PIP signal (13), the output of the firing sequence counter (28), and input from the double edge detector (26). Based upon this data, the SPOUT low detector (23) determines when the SPOUT signal (31) has faulted low. When the SPOUT signal (31) faults low, the SPOUT low detector (23) enables the SPOUT disable unit (24) to block transmission of the SPOUT signal (31) to the cutput logic unit (29). In addition, the SPOUT low detector (23) enables a clock disable unit (27) that prevents the delayed SPOUT signal from reaching the firing sequence counter (28). Finally, the SPOUT low detector (23) causes both the PIP signal (13) and the CID signal (14) to be substituted for the SPOUT signal (31) to allow the output logic unit (29) to continue providing a useable spark signal to the distributorless ignition (17).

The firing sequence counter (28) can operate to advance the firing sequence in response to both the CID signal (14) as processed through the double edge detector (26) and the SPOUT signal (31). During normal operation, the SPOUT signal (31) will advance the firing sequence, and the CID signal (14) serves as a confirmation or correction if necessary. Therefore, even upon losing the CID signal (14), the counter (28) can effectively drive the output logic unit (29) so long as the engine (11) is not switched off. In the alternative, the firing sequence counter (28) will continue to increment properly even in the absence of the SPOUT signal (31) due to the use of the CID signal (14).

The double edge detector (26) monitors the CID signal (14) and provides output signals that relate to the position of each cylinder in the engine (11), which signals are used as indicated above.

Figure 3:
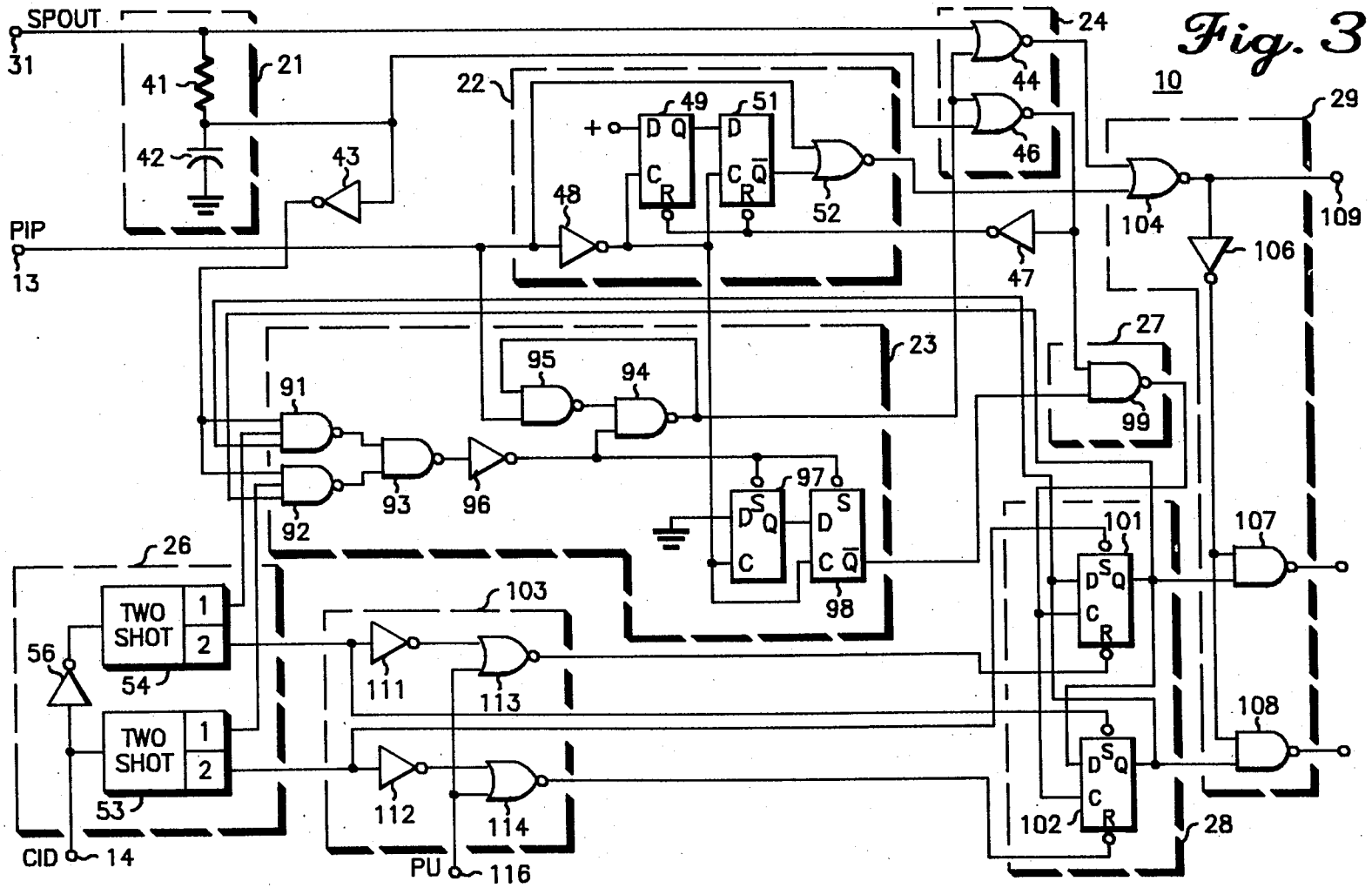
FIG. 3 comprises a schematic diagram of the invention.

Referring now to FIG. 3, a more detailed description of the invention (10) will be provided.

The input of the SPOUT signal delay unit (21) and the input of the SPOUT disable unit (24) both connect to receive the SPOUT signal (31). The SPOUT signal delay unit (21) includes a 100 K ohm resistor (41) and a grounded, 0.001 microfarad capacitor (42). The junction of the latter two components (41 and 42) comprises the output of the SPOUT signal delay unit (21), and provides the SPOUT signal (31) as delayed approximately 100 microseconds. The SPOUT disable unit (24) receives the delayed SPOUT signal and the SPOUT low detector (23) receives the delayed SPOUT signal as inverted by an inverter (43).

The SPOUT disable unit (24) includes two NOR gates (44 and 46). The inputs of the first NOR gate (44) connect to receive the SPOUT signal (31) and an output control signal of the SPOUT low detector (23) as described below in more detail. The second NOR gate (46) connects to receive the same SPOUT low detector output control signal as the first NOR gate (44) and the delayed SPOUT signal from the SPOUT signal delay unit (21). The output of the first NOR gate (44) connects to the output logic unit (29). The output of the second NOR gate (46) connects to the clock disable unit (27) and also through an inverter (47) to the SPOUT high detector (22).

The SPOUT high detector (22) has an input for receiving the PIP signal (13), which input connects to one input of a two input NOR gate (52) and also through an inverter (48) to the clock port of first and second flip-flops (49 and 51). The inverter (48) also connects to the SPOUT low detector (23) as described below. The D input of the first flip-flop (49) connects to a positive voltage source, and the Q output connects to the D input of the second flip-flop (51). The not reset port for both flip-flops (49 and 51) connects to the above noted inverter (47) that connects to the output of the second SPOUT disable unit NOR gate (46). The not Q output of the second flip-flop (51) connects to the remaining input of the SPOUT high detector NOR gate (52). The output of this NOR gate (52) connects to the output logic unit (29) as described below.

The double edge detector (26) connects to receive the CID signal (14). The double edge detector (26) includes 2 two shot monostables (53 and 54). The CID signal (14) connects directly to the input of the first two shot (53) and through an inverter (56) to the input of the second two shot (54).

Figure 4:
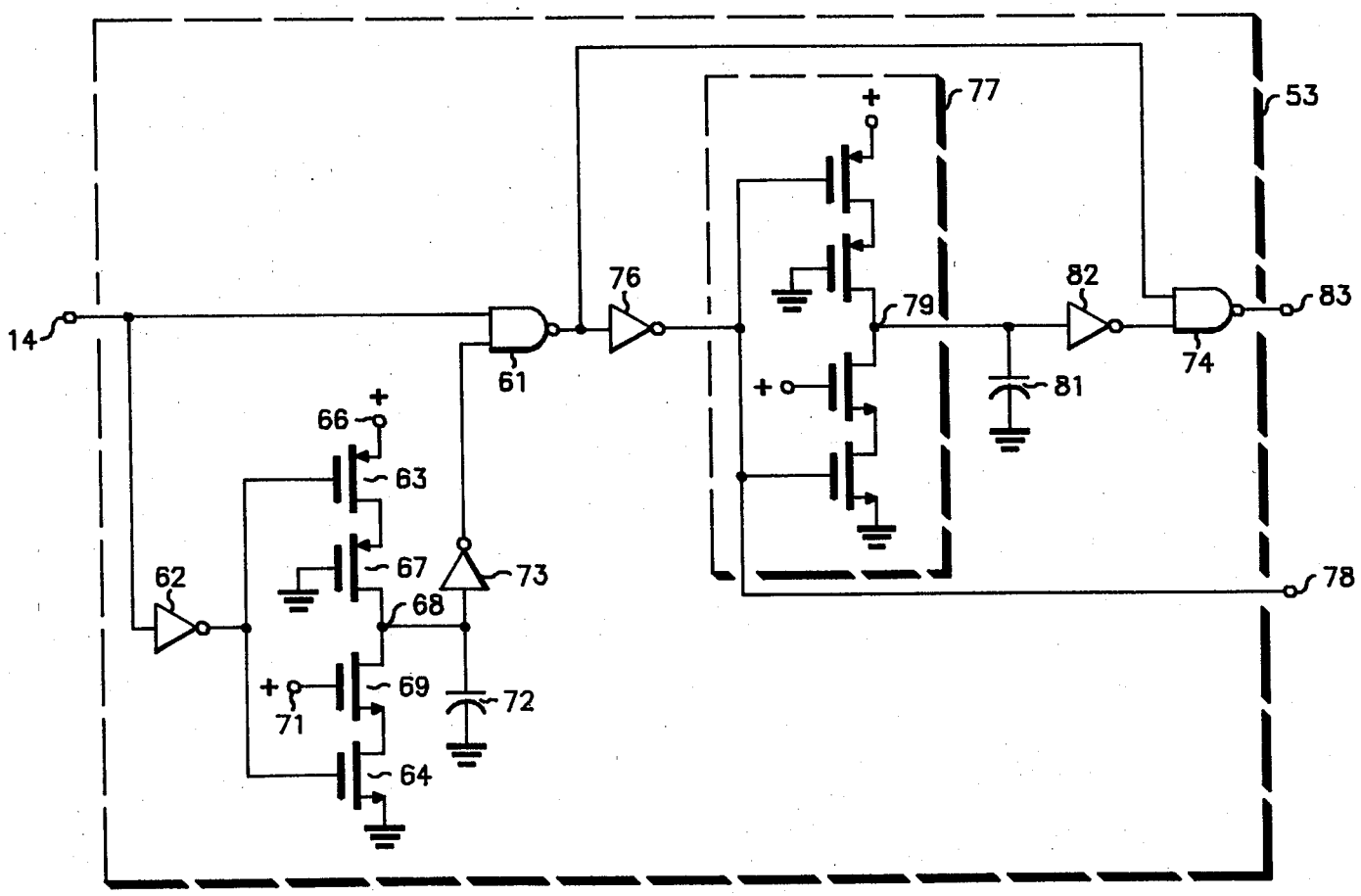
FIG. 4 comprises a schematic diagram of the double edge detector unit of the invention.

Referring now momentarily to FIG. 4, the two shots (53 and 54) will be described in more detail. Since both two shots (53 and 54) are identical, only one (53) will be described in detail.

The CID input signal (14) connects to one input of a first two input NAND gate (61) and also through an inverter (62) to the gate of a first P channel FET (63) and the gate of a first N channel FET (64). The drain of the first P channel FET (63) connects to a positive voltage source (66), and the source connects to the drain of a second P channel FET (67). The gate of the second P channel FET (67) connects to ground and the source connects to a control node (68). The drain of the first N channel FET (64) connects to ground and the source connects to the drain of a second N channel FET (69). The gate of the second N channel FET (69) connects to a positive voltage source (71) and the source connects to the control node (68).

The control node (68) connects to a grounded 9 picofarad capacitor (72) and through an inverter (73) to the remaining input of the first two input NAND gate (61) referred to above.

The output of the first two input NAND gate (61) connects to one input of a second two input NAND gate (74) and also through an inverter (76) to a second array of FETs (77) that are configured exactly as described above for the first four FETs (63, 64, 67, and 69). In addition, the output of the inverter (76) comprises the first output (78) of the first two shot (53).

The control node (79) of the second FET array (77) connects to a grounded 9 picofarad capacitor (81) and through an inverter (82) to the remaining input of the second two input NAND gate (74). The output of this NAND gate (74) comprises the second output (83) of the first two shot (53).

Referring again to FIG. 3, this detailed description of the invention (10) will continue.

The SPOUT low detector (23) includes 3 two input NAND gates (93, 94, and 95), 2 .three input NAND gates (91 and 92), one inverter (96), and 2 flip-flops (97 and 98). The first three input NAND gate (91) has one input connected to the first output of the second double edge detector two shot (54), the second input connected to receive the inverted delayed SPOUT signal, and the third input connected to receive an output signal from the firing sequence counter (28) as described below. Similarly, the inputs of the second three input NAND gate (92) connect to receive the first output of the first double edge detector two shot (53), the inverted delayed SPOUT signal, and an output signal from the firing sequence counter (28) as described below. The outputs of the three input NAND gate (91 and 92) connect to the inputs of the first two input NAND gate (93). The output of the first two input NAND gate (93) connects through the inverter (96) to one input of the second two input NAND gate (94) and also to the not set port of the two flip-flops (97 and 98).

The output of the second two input NAND gate (94) connects to one input of the third two input NAND gate (95) and to both of the SPOUT disable unit NOR gates (44 and 46) described above. The remaining input of the third two input NAND gate (95) connects to receive the PIP signal (13), and the output connects to the remaining input of the second two input NAND gate (94).

The data port of the first SPOUT low detector flip-flop (97) connects to ground, and the data port of the second flip-flop (98) connects to the Q output port of the first flip-flop (97). The clock ports of both flip-flops (97 and 98) are connected to receive the inverted PIP signal as developed by the SPOUT high detector inverter (48) described above. The not Q output of the second flip-flop (98) connects to the clock disable unit (27).

The clock disable unit (27) includes a two input NAND gate (99) that has one input connected to receive the not Q output of the second SPOUT low detector flip-flop (98) and the remaining input connected to receive the SPOUT delayed signal as provided through the SPOUT disable unit (24). The output of this NAND gate (99) connects to the clock input ports of the two flip-flops (101 and 102) that comprise the firing sequence counter (28).

The not set port of the first firing sequence counter flip-flop (101) connects to the second output of the first double edge detector two shot (53). The not set port of the second flip-flop (102) connects to receive the second output of the second double edge detector two shot (54). The Q output port of the first flip-flop (101) connects to the data port of the second flip-flop (102) and also to one input of the second SPOUT low detector three input NAND gate (92) as described above. The Q output port of the second firing sequence counter flip-flop (102) connects to the data port of the first flip-flop (101) and also to one input of the first SPOUT low detector three input NAND gate (91) as described above. The not reset ports for both flip-flops (101 and 102) connect to a reset inhibit unit (103) described in more detail below. Finally, the Q output ports of both firing sequence counter flip-flops (101 and 102) connect to the output logic unit (29) as described below.

The output logic unit (29) includes 1 two input NOR gate (104), an inverter (106), and 2 two input NAND gates (107 and 108). The two input NOR gate (104) has one input connected to receive the SPOUT signal (31) as passed through the SPOUT disable unit (24), and the remaining input connected to receive the output of the SPOUT high detector (22). The output of this NOR gate (104) connects to provide a tachometer circuit output (109) as may be desired, and also through the inverter (106) to one input each of the 2 two input NAND gates (107 and 108).

The remaining input of the first NAND gate (107) connects to the Q output port of the first firing sequence counter flip-flop (101). The remaining input of the second NAND gate (108) connects to the Q output port of the second firing sequence counter flip-flop (102). The outputs of these two NAND gates (107 and 108) provide the output control signals that can be utilized by a distributorless ignition system for the purposes described above.

The reset inhibit unit (103) mentioned briefly above includes two inverters (111 and 112) and 2 two input NOR gates (113 and 114). The input of the first inverter (111) connects to the second output of the second double edge detector two shot (54). The output of this inverter (111) connects to one input of the first NOR gate (113).

The input of the second inverter (112) connects to the second output port of the first double edge detector two shot (53). The output of this inverter (112) connects to one input of the second NOR gate (114).

The output of the first NOR gate (113) connects to the not reset port of the first firing sequence counter flip-flop (101). The output of the second NOR gate (114) connects to the not reset port of the second firing sequence counter flip-flop (102). The remaining input of each NOR gate (113 and 114) connects to receive an inhibit signal (116) that may be utilized to prohibit operation of the firing sequence counter (28) under certain predetermined circumstances as explained below.

Operation of the invention (10) will now be generally set forth.

Figure 1:
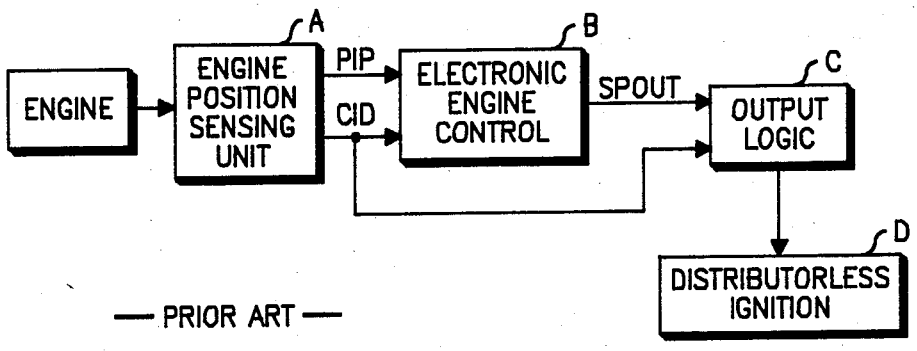
FIG. 1 comprises a block diagram depiction of a prior art system.
Figure 5:
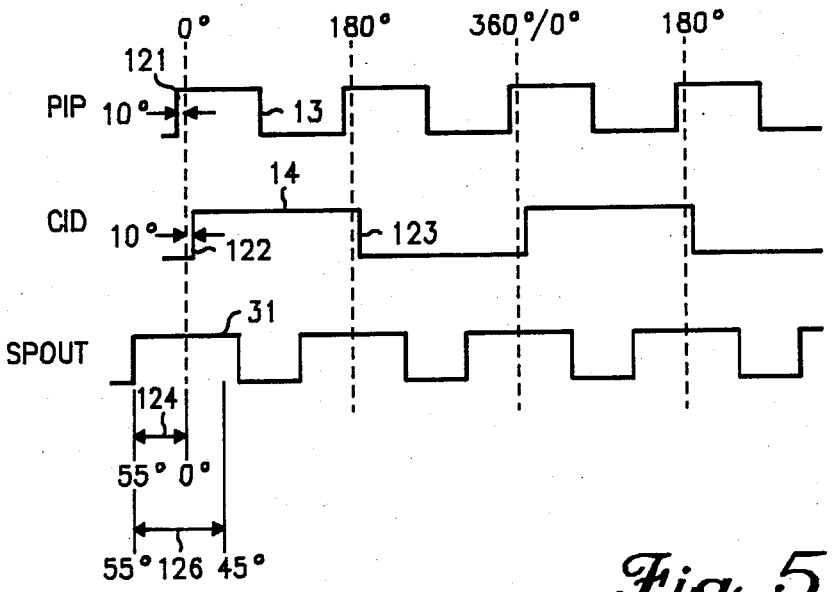
FIG. 5 comprises waveform diagrams of the incoming signals to the system.

With reference to FIG. 5, the PIP signal (13) comprises a rectangular shaped waveform having a rising edge (121) that occurs at about 10 degrees prior to top dead center (at zero degrees and 180 degrees of engine revolution movement). The CID signal (14) has a rising edge (122) that occurs about 10 degrees subsequent to top dead center at zero degrees of engine revolution, and a falling edge (123) that occurs about 10 degrees subsequent to 180 degrees of engine revolution. The SPOUT signal (31) comprises a rectangular shaped waveform having a pulse width that varies in dependence upon the incoming information and the control strategy of the electronic engine control (16) (FIG. 2). In general, the theoretical range of SPOUT dictates a pulse width (124) from between 55 degrees prior to top dead center and zero degrees. In practice, however, a pulse width range (126) of between 55 degrees prior to top dead center and 45 degrees subsequent to top dead center may occur due to rapid acceleration conditions.

Referring again to FIG. 3, this SPOUT signal (31) passes through the SPOUT disable unit (24) and is utilized by the output logic unit (29) to provide the firing control signal output under ordinary circumstances. In addition, the SPOUT signal delay unit (21) provides a delayed SPOUT signal that lags the SPOUT signal (31) by approximately 100 microseconds.

The SPOUT high detector (22) receives the PIP signal (13) and functions to count the falling edges of the PIP signal (13). In the normal presence of a delayed SPOUT signal, the SPOUT high detector flip-flops (49 and 51) will be reset when the count equals one. In the absence of a SPOUT delay signal, however, as when the SPOUT signal faults high, the count will advance to two. When this happens, the PIP signal (13) will be ORed into the firing control signal path by the output logic unit NOR gate (104). If the SPOUT delayed signal should return, the two flip-flops (49 and 51) will be reset, and subsequent SPOUT signals (31) (if any) will be utilized to again provide the firing control signal. If the SPOUT signal should again fault high, the two flip-flops (49 and 51) will again increment to two and substitute the PIP signal (13) as described above.

The double edge detector (26) receives the CID signal (14) and provides four output signals in response thereto. The first output of the first double edge detector two shot (53) provides a pulse in response to the leading edge of the CID signal pulse. The second output of this two shot (53) provides a pulse that lags the output pulse of the first output by approximately 200 microseconds. The first output of the second double edge detector two shot (54) provides a pulse in response to the falling edge of the CID signal (14). The second output of this two shot (54) lags the output of the first output by approximately 1 microseconds.

The SPOUT low detector (23) receives the nondelayed signals from the double edge detector (26), the inverted delayed SPOUT signal, and the output signals of the firing sequence counter flip-flops (101 and 102). In effect, the inverted delayed SPOUT signal is ANDed with the positive and negative CID signal edges and the output of the firing sequence counter. The resulting output sets the two SPOUT low detector flip-flops (97 and 98). Since the SPOUT signal will normally be high when the CID signal (14) is received, the two flip-flops (97 and 98) will remain normally reset.

In this state, the not Q output of the second flip-flop (98) will cause the clock disable unit (27) to allow the delayed SPOUT signal to clock the firing sequence. If the SPOUT signal (31) should fault low, however, the two SPOUT low detector flip-flops (97 and 98) will set, thereby enabling the clock disable unit (27) and preventing the delayed SPOUT signal from clocking the two firing sequence flip-flops (101 and 102).

When this occurs, sequencing of the firing sequence counter (28) will occur under the control of the delayed positive and negative CID signals through the setting and resetting of the two firing sequence flip-flops (101 and 102). Also during this time, the positive and negative CID signals become the firing control signal by virtue of the operation of the SPOUT low detector (23). Since the first outputs from the two double edge detector two shots (53 and 54) have a duration of approximately 1 microseconds, the duty cycle of the two output logic unit NAND gates (107 and 108) constitutes a very high percentage of each cycle. To reduce the percentage of this duty cycle, the first outputs from the two double edge detector two shots (53 and 54) disable the second SPOUT low detector NAND gate (94), which gate is cross wired with the third SPOUT low detector NAND gate (95) to form a latch. This prevents the former gate (94) from being enabled until the latter NAND gate (95) is disabled by the PIP signal going low at 90 and 270 degrees. Thus, the two output logic unit NAND gates (107 and 108) are disabled between a raising or falling edge of the CID signal and the following falling edge of the PIP signal. In short, when the SPOUT signal (31) faults low, the CID signal (14) provides the ignition signal and the PIP signal (13) reduces the percentage of the above noted duty cycle.

If the SPOUT signal should return from its faulted low condition, the two SPOUT low detector flip-flops (97 and 98) will count two PIP signals (13) and then reenable the clock disable unit (27). The delayed SPOUT signal will then again cause the firing counter sequence flip-flops (101 and 102) to clock and sequence as before.

At power up, both of the firing sequence counter flip-flops (101 and 102) are reset by the reset inhibit unit (103). The double edge detector (26) processes the CID signal (14) as described above, and the resultant signals are utilized to synchronize the firing sequence counter (28) through the setting and resetting of the two firing sequence counter flip-flops (101 and 102). The sequencing of the firing sequence counter (28) will thereafter be controlled by the delayed SPOUT signal when present, or by the delayed positive and negative CID signals as generated by the double edge detector (26) in the absence of the delayed SPOUT signal. If the firing sequence counter (28) should become unsynchronized with respect to the engine, the delayed positive and negative CID signals as generated by the double edge detector (26) will resynchronize the firing sequence counter (28) at the next positive or negative CID signal.

If the CID signal (14) becomes lost, the firing sequence counter (28) will continue to sequence under control of the delayed SPOUT signal, using the last received CID signal (14) as a reference. If the CID signal (14) is regained, the counter sequence will continue to be reaffirmed. If, however, the engine is shut down while the CID signal (14) has been lost, and the CID signal (14) cannot be regained upon restarting the engine, power up will be unsuccessful. Once the firing sequence counter flip-flops (101 and 102) have been reset by the reset inhibit unit (103) at power up, the firing sequence cannot be reestablished in the absence of the CID signal (14).

Through use of the above described invention, a number of signal fault conditions can be detected and appropriately responded to. Should the SPOUT signal fault low, sequencing of the firing sequence counter (28) will proceed under control of the CID signal (14) and the CID signal (14) will further be utilized as a reference to control the firing control signal. If the SPOUT signal faults high, the firing sequence counter (28) will again increment as described above, and the firing control signal function will be met through use of the PIP signal. Finally, in the absence of the CID signal (14), the firing sequence counter (28) will continue to properly increment under control of the SPOUT signal, so long as the engine remains operating. In addition, the invention provides for recovery of normal operation should the signal fault prove to be transient.

Those skilled in the art will recognize that the above described embodiment could be modified to meet various needs without departing from the spirit of the invention. It should therefore be understood that the claims for this invention should not be considered as limited to the specific embodiment described in the absence of specific recitations to the contrary.

We claim:

1. In a distributorless ignition system suitable for use with:

an engine;

engine position sensing means for providing a PIP signal relating to crankshaft location information for said engine, and a CID signal relating to identification of a particular cylinder in said engine; and electronic engine control means for receiving said PIP and CID signals and for providing a SPOUT signal containing spark advance/retard and dwell information to said distributorless ignition system;

an improvement comprising:

(a) SPOUT low detection means for detecting when said SPOUT signal faults low and for causing said PIP signal and said CID signal to be operably substituted therfore; and (b) SPOUT signal delay means for receiving said SPOUT signal and for providing a delayed SPOUT signal that comprises the SPOUT signal as delayed a predetermined period of time; wherein said SPOUT low detection means receives and monitors said delayed SPOUT signal to detect when said delayed SPOUT signal, and hence said SPOUT signal, has faulted low.

2. In a distributorless ignition system suitable for use with:

an engine;

engine position sensing means providing a PIP signal relating to crankshaft location information for said engine, and a CID signal relating to indentification of a particular cylinder in said engine; and electronic engine control means for receiving said PIP and CID signals and for providing a SPOUT signal containing spark advance/retard and dwell information to said distributorless ignition system;

an improvement comprising:

(a) SPOUT low detection means for detecting when said SPOUT signal faults low and for causing said PIP signal and said CID signal to be operably substituted therefore; and (b) SPOUT disable means for receiving and transmitting said SPOUT signal, and for selectively disabling transmission of said SPOUT signal in response to a disable signal.

3. The improvement of claim 2 wherein said SPOUT low detection means receives signals related to said CID signal and produces said disable signal when said CID signal is present and said SPOUT signal is not substantially simultaneously present.

4. The improvement of claim 3 and further including SPOUT signal delay means for receiving said SPOUT signal and for providing a delayed SPOUT signal that comprises the SPOUT signal as delayed a predetermined period of time; wherein said SPOUT low detection means receives and monitors said delayed SPOUT signal to detect when said delayed SPOUT signal, and hence said SPOUT signal, has faulted low.

5. In a distributorless ignition system suitable for use with:

an engine;

engine position sensing means for providing a PIP signal relating to crankshaft location information for said engine, and a CID signal relating to indentification of a particular cylinder in said engine; and electronic engine control means for receiving said PIP and CID signals and for providing a SPOUT containing spark advance/retard and dwell information to said distributorless ignition system;

an improvement comprising:

(a) SPOUT low detection means for detecting when said SPOUT signal faults low and for causing said PIP signal and said CID signal to be operably substituted therefore; and (b) firing sequence counter means for controlling ignition sequencing if said engine, wherein said firing sequence counter means ordinarily advances said sequence in response to said SPOUT signal, and confirms said sequencing in response to detection of at least one signal related to said CID signal.

6. The improvement of claim 5 wherein said SPOUT low detection means inhibits transmission of said SPOUT signal to said firing sequence counter means when said SPOUT signal has faulted low, and wherein said firing sequence counter means will advance said sequence based on said CID signal when said SPOUT signal faults low.

7. In a distributorless ignition system suitable for use with:

an engine;

engine position sensing means for providing a PIP signal relating to crankshaft location information for said engine, and a CID signal relating to identification of a particular cylinder in said engine; and electronic engine control means for receiving said PIP and CID signals and for providing a SPOUT signal containing spark advance/retard and dwell information to said distributorless ignition system;

an improvement comprising:

(a) SPOUT low detection means for detecting when said SPOUT signal faults low and for causing said PIP signal and said CID signal to be operably substituted therefore; and (b) SPOUT high detection means for detecting when said SPOUT signal faults high and for replacing said SPOUT signal with said PIP signal.

8. In a distributorless ignition system suitable for use with:

an engine;

engine position sensing means for providing a PIP signal relating to crankshaft location information for said engine, and a CID signal relating to identification of a particular cylinder in said engine; and electronic engine control means for receiving said PIP and CID signals and for providing a SPOUT signal containing spark advance/retard and dwell information to said distributorless ignition system;

an improvement comprising SPOUT high detection means for detecting when said SPOUT signal faults high and for replacing said SPOUT signal with said PIP signal.

9. The improvement of claim 8 and further including SPOUT signal delay means for receiving said SPOUT signal and for providing a delayed SPOUT signal in response thereto, wherein said SPOUT high detection means receives said delayed SPOUT signal.

10. The improvement of claim 8 wherein said SPOUT high detection means includes means for counting consecutive PIP signals.

11. The improvement of claim 10 wherein said SPOUT high detection means replaces said SPOUT signal with said PIP signal when said SPOUT signal remains high for a predetermined number of consecutive PIP signal occurrences.

12. The improvement of claim 11 wherein said predetermined number of consecutive PIP signal occurrences equals at least two.

13. In a distributorless ignition system suitable for use with:

an engine;

engine position sensing means for providing a PIP signal relating to crankshaft location information for said engine, and a CID signal relating to identification of a particular cylinder in said engine; and electronic engine control means for receiving said PIP and CID signals and for providing a SPOUT signal containing spark advance/retard and dwell information to said distributorless ignition system;

an improvement comprising firing sequence counter means responsive to said SPOUT signal and to said CID signal, for advancing an ignition firing sequence for said engine in response to said SPOUT signal when said SPOUT signal is available, and for advancing said ignition firing sequence in response to said CID signal when said SPOUT signal is not available.

14. The improvement of claim 13 and further including:

(a) SPOUT low detection means for detecting when said SPOUT signal faults low and for causing said PIP signal and said CID signal to be operably substituted therefore; and (b) SPOUT high detection means for detecting when said SPOUT signal faults high and for replacing said SPOUT signal with said PIP signal.

15. The improvement of claim 14 and further including SPOUT signal delay means for receiving said SPOUT signal and for providing a delayed SPOUT signal that comprises the SPOUT signal as delayed a predetermined period of time, wherein said SPOUT low detection means receives and monitors said delayed SPOUT signal and wherein said SPOUT high detection means receives said delayed SPOUT signal.

* * * * *

UNITED STATES PATENT AND TRADEMARK OFFICE

CERTIFICATE OF CORRECTION

PATENT NO. : 4,658,786

DATED : April 21, 1987

INVENTOR(S) : Leonard Foss et al.

It is certified that error appears in the above-identified patent and that said Letters Patent is hereby corrected as shown below:

Column 4, line 12, "cutput" should be --output--.

Signed and Sealed this

Eleventh Day of August, 1987

*Attest:*

*Attesting Officer*

DONALD J. QUIGG

*Commissioner of Patents and Trademarks*